United States Patent [19]

Dempsey et al.

[11] 4,216,364

[45] Aug. 5, 1980

[54] HIGH CURRENT CELL-SHORTING SWITCHES

[75] Inventors: Martin H. Dempsey, Stratford; James F. Rooney, Bethany, both of Conn.

[73] Assignee: Olin Corporation, New Haven, Conn.

[21] Appl. No.: 966,136

[22] Filed: Dec. 4, 1978

[51] Int. Cl.[2] ..... H01H 1/38

[52] U.S. Cl. ..... 200/164 R; 200/252; 200/281

[58] Field of Search ..... 200/153 G, 163, 164 R, 200/252, 254, 281, 162, 275; 403/344; 308/22, 74, 75

[56] References Cited

U.S. PATENT DOCUMENTS

| | | | |
|---|---|---|---|
| 742,905 | 11/1903 | Richter | 308/74 X |
| 768,610 | 8/1904 | Lindall | 200/281 |
| 781,426 | 1/1905 | Hollingworth | 308/22 X |
| 2,579,799 | 12/1951 | Crabbs | 403/344 X |
| 2,585,824 | 2/1952 | Noyes | 200/281 X |
| 2,738,240 | 3/1956 | Parsons | 308/28 X |
| 2,743,338 | 4/1956 | Graybill | 200/153 G X |
| 2,766,335 | 10/1956 | Graybill | 200/153 G X |
| 2,816,587 | 12/1957 | Kagley et al. | 403/344 X |
| 3,315,189 | 4/1967 | Heft et al. | 200/153 G X |
| 3,606,505 | 9/1971 | Satterthwaite et al. | 308/74 X |

*Primary Examiner*—Stephen Marcus

*Attorney, Agent, or Firm*—Bruce E. Burdick; Thomas P. O'Day

[57] ABSTRACT

A high current cell-shorting switch is provided with removable bus bar tips having an enlarged beveled area of contact. A plurality of movable tapered bridge contacts are arranged along a main shaft such that upon rotation of the shaft a plurality of the bridge contacts are simultaneously driven into spanning contact with two of the bus bar tips. The main shaft is supported by pairs of split collars which can be easily separated thereby permitting removal of the main shaft and associated contacts. Upon separation, the switch contacts and bus bar tips may be easily removed for refurbishing or replacement.

20 Claims, 22 Drawing Figures

HIGH CURRENT CELL-SHORTING SWITCHES

BACKGROUND OF THE INVENTION

This invention relates to improved high current cell shorting switches. The switches are particularly applicable in chlorine production plants where large amounts of current are utilized. These plants often contain as many as 200 chlorine producing cells connected in series, each of which may contain as many as 20 power grids.

Normally, the voltage across each cell is comparatively low thus leaving the output of the cell directly proportional to the operating current. Currents in excess of 8,000 amperes are not unusual.

When it becomes necessary to service one of the cells it would be highly undesirable to shut down the entire line. To solve this problem, it is known to insert a switch or switches across the terminals of the defective cell thus providing a shunt circuit in the series system and enabling the cell to be serviced.

As noted above, each cell might contain as many as 20 power grids, thereby necessitating the use of 20 shorting switches for each cell. A representative plant might then typically have as many as 2,000 shorting switches installed at any one time.

Because of the large currents which pass through the system and the switch contacts it has been found desirable to connect a multiplicity of contacts in parallel. The problem which arises however is that provision must be made for self-alignment and effective simultaneous engagement and disengagement of the contacts.

Moreover, because of the relatively high magnitudes of current carried by the shorting switches, the contact surfaces have a tendency to burn and corrode. This tendency is greatly accelerated if the contacts do not engage simultaneously and/or if the contacts make only point or line contact over a relatively small area.

The problem therefore is to provide a switch which makes highly effective contact over a large area and which can be easily repaired after contact elements degenerate over a period of time. Naturally, since an entire cell must be shut down during any repair, rapid repair or replacement of defective switch contacts is highly advantageous. In the past this has proven to be a substantial problem since repair of the switches has necessitated the removal of them from the installation. These switches can weigh in excess of 100 pounds and are often mounted such that repairmen must work from below the switch installation. This has normally been a two-man repair operation.

Further, upon removal of damaged switches, it is often essential to replace larger copper bus bars which have worn contact surfaces.

It is the object of this invention to obviate the problems of labor, material, and shut down costs attendant the need for refurbishing of high current cell shorting switches.

PRIOR ART STATMENT

A low voltage, high current switch is shown in U.S. Pat. No. 2,743,338 to Graybill. The patent describes a system of multiple movable bridging contacts which are seated by rotation of a control shaft. The bridging contacts are shown to have a semi-cylindrical shape while the terminal connectors have stationary straight bevel contact surfaces. It has been found that when bridging contacts are provided with such a curved contact surface and are used under high current conditions a reduced area of contact occurs which leads to accelerated corrosion and burning of the contact surfaces. Another problem which arises with the device of U.S. Pat. No. 2,743,338 is that when repair of contact surfaces is required, a great deal of material and labor must be extended. This is so for two reasons. First, the L-shaped terminal connectors must be discarded and replaced once the stationary contact portions thereof are badly worn. Second, the collars which hold the control shaft necessitate removal of the side plates and therefore removal of the entire switch to replace any worn bridging contacts.

In U.S. Pat. No. 2,766,335 to Graybill shaft thrown semi-cylindrical movable contacts are also shown. The device however has multiple shafts and provides the same disadvatageous contact as U.S. Pat. No. 2,743,338. Moreover, upon severe wear or damage of both stationary and movable contact surfaces, complete disassembly of the device and subsequent discarding of worn stationary contacts would be required.

In U.S. Pat. No. 3,703,621 to Viola et al. a reciprocating frusto-conical plug switch contact is shown. The operation of the switch and the environment used in are entirely different than that of the present invention.

SUMMARY OF THE INVENTION

In accordance with this invention an improved cell-shorting switch is provided which is particularly adapted for use in high current low voltage environments.

A plurality of movable tapered contacts are provided which firmly seat with and bridge beveled tips located at the ends of opposed bus bars. The contacts and the bus bar tips are ideally screw mounted to permit easy removal and refurbishing of worn or damaged surfaces. To enhance contact the bus bar tips are provided with a large mass such that they are thicker than the bus bars themselves.

The plurality of movable tapered contacts are thrown or seated by rotation of a main shaft. In a preferred form of this invention the main shaft is supported for rotation by split collars which can be separated by removal of screws. Thus, when it is desired to refurbish or replace worn contact surfaces it is only necessary to remove the shaft with the movable contacts secured thereto. Easy access to the screw secured bus bar tips and the screw secured movable contacts is then available without the need to remove the entire switch from the line installation. This ability results in large savings in both material and manpower costs.

Accordingly, it is an object of this invention to provide an improved cell shorting switch.

These and other objects will become more apparent from the following description and drawings.

DETAILED DESCRIPTION OF PREFERRED EMBODIMENTS

Figure 1:
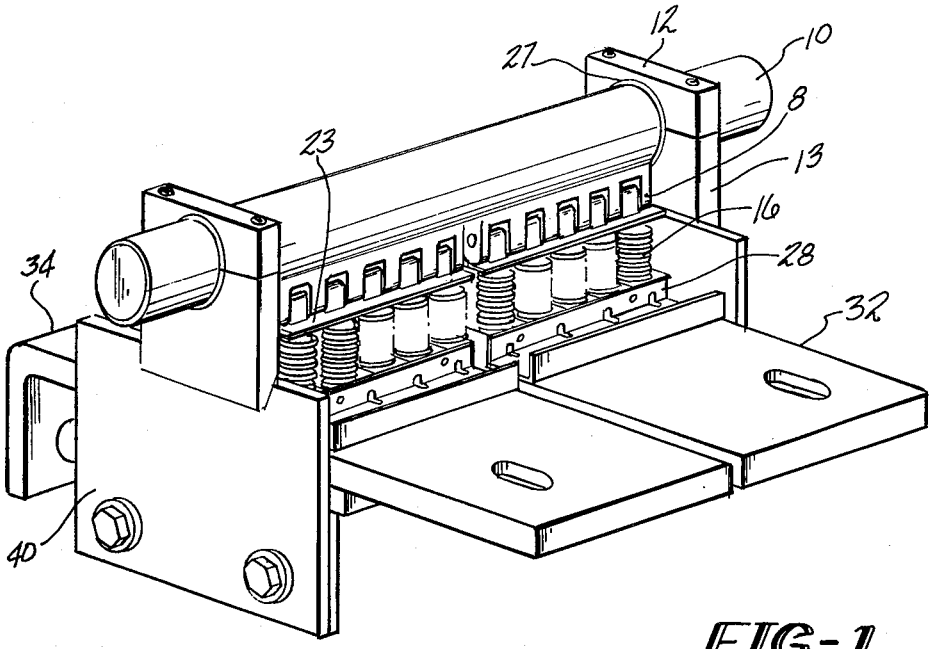
FIG. 1 is a perspective view of a shorting switch in accordance with this invention.

Referring now to FIGS. 1, 2, 3, 4 and 5, a main operating shaft 10 is shown journaled in split bushings 27 located in split collars 12 and 13. Split collars 12 and 13 may be keyed to main shaft 10 to prevent endwise motion of the shaft. Operating lever 9 is secured to main shaft 10 so that movement of the lever will cause rotation of the main shaft 10. Lever 9 may be secured to shaft 10 in any suitable manner such as by welding, insertion in a hole in shaft 10, etc., and can be manually or pneumatically operated. It is also contemplated that interconnecting couplings be secured to a plurality of main shafts 10 such as by roll pins thus providing the coupling together of a plurality of switches which can then be pneumatically thrown simultaneously.

Figure 15:
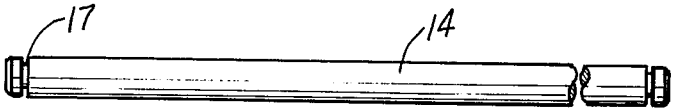
FIG. 15 is a front view of the movable contact support shaft of the switch of FIG. 2.
Figure 16:
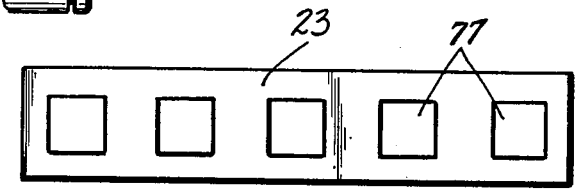
FIG. 16 is a top view of the spring stop of the switch of FIG. 2.
Figure 19:
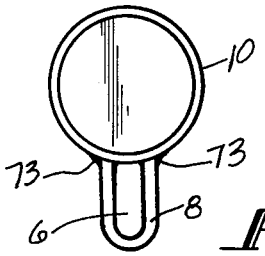
FIGS. 19 and 20 are side and front views respectively of the main shaft of the switch of FIG. 2.
Figure 20:
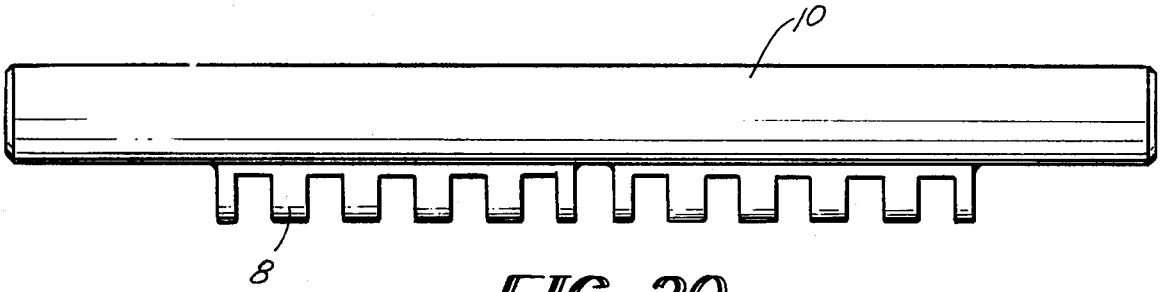

Main shaft 10 has a plurality of U-shaped arms 8 protruding therefrom. Arms 8 may be integral with shaft 10, but in the preferred embodiment are secured extending radially from shaft 10 via welds 73 (FIG. 19). Legs 8 form an elongated slot 6 which extends radially from the main shaft 10 and act as a guide for movable contact support shaft 14 (FIG. 15). Contact support shaft 14 is strung transversely and intermittently through the elongated slots 6 and the closed end of slots 29 formed in contact and spring supports 15. Shaft 14 is secured in place by retaining rings 18 located in grooves 17. The open end of contact and spring supports 15 have tapered bridge contacts 5 secured thereto. Selected sets of contact and spring supports 15 have spring stop 23 mounted thereon such that the closed ends of supports 15 pass through square holes 77 therein. (FIG. 16). Each contact and spring support 15 has a concentric spiral compression spring 16 resting at each end against spring stop 23 and flanged end 31. When main shaft 10 is in the closed position of FIG. 3, compression springs 16 will urge bridging contacts 5 downward into tight engagement with bus bar tips 37.

Flat bus bars 32 and L-shaped bus bars 34 are secured to main switch frame 30 by hex head bolts 30, lock washers 22 and nuts 21. Insulator blocks 11 are interposed between bus bars 32 and 34 and frame 30 as well as between frame 30 and washers 25. Phenolic insulator sleeves 24 are placed around bolts 41 which pass through and align bus bars 32 and 34, frame 30 and insulator blocks 11. One end of bus bars 32 and 34 is provided with means 82 for electrical connection to the circuit. The other end of the bus bars are provided with bus bar tips 37 which are provided with a beveled contact surface 35. The taper of bridge contact 5 is made to mate with tips 37 so as to provide complete contact along the surface 35. Bus bar tips 37 constitute the stationary contacts in the switch.

Figure 13:
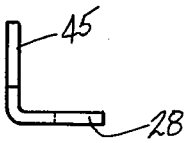
FIGS. 11–13 depict various views of the insulator-protector portion of the switch of FIG. 2.
Figure 12:
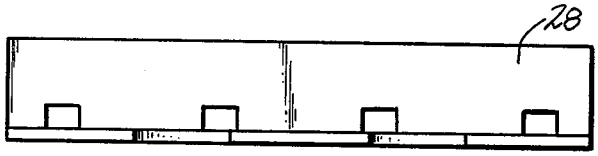
Figure 14:
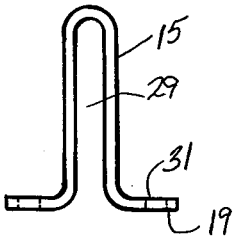
FIG. 14 is a side view of the movable contact and spring support element of the switch of FIG. 2.
Figure 11:
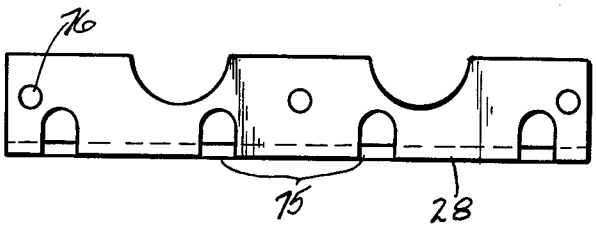

Reinforced fiberglass insulators 28 are secured to bus bars 32 and 34 by allen cap screws 38 passing through holes 76. The vertical wall portions 45 of insulators 28 serve as guides to assure proper seating of the movable tapered contacts 5. Insulators 28 are also provided with access openings 75 which permit easy removal of allen screws 38 which secure removable bus bar tips 37 to bus bars 32 and 34. (FIGS. 11, 12 and 13).

Figure 3:
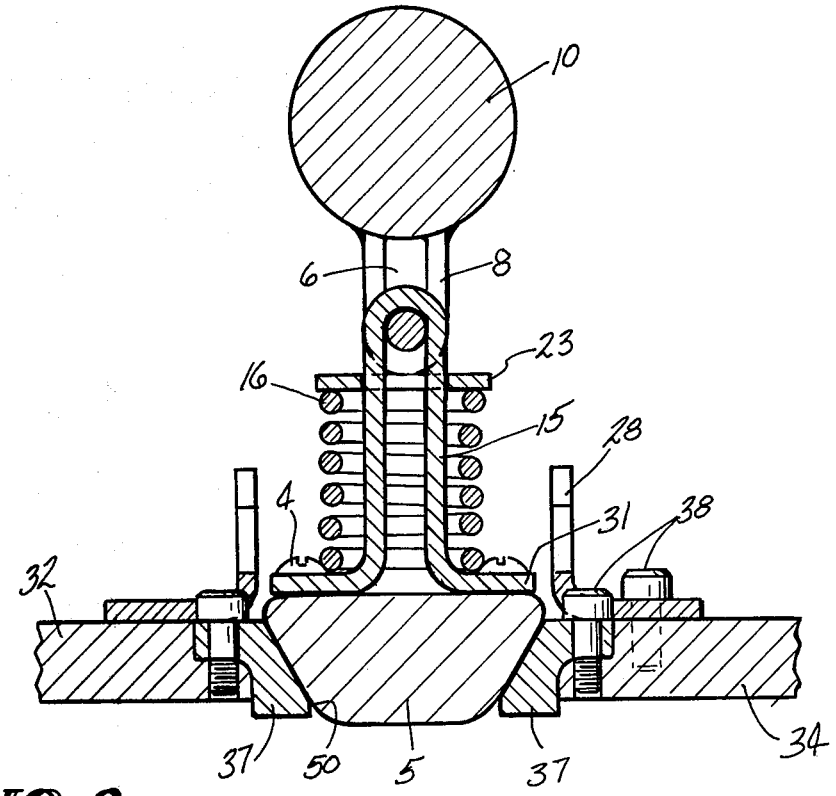
FIG. 3 is a partial section taken along the line A—A of FIG. 2 showing the movable tapered bridge contacts in full engagement with the bus bar tips of this invention.
Figure 4:
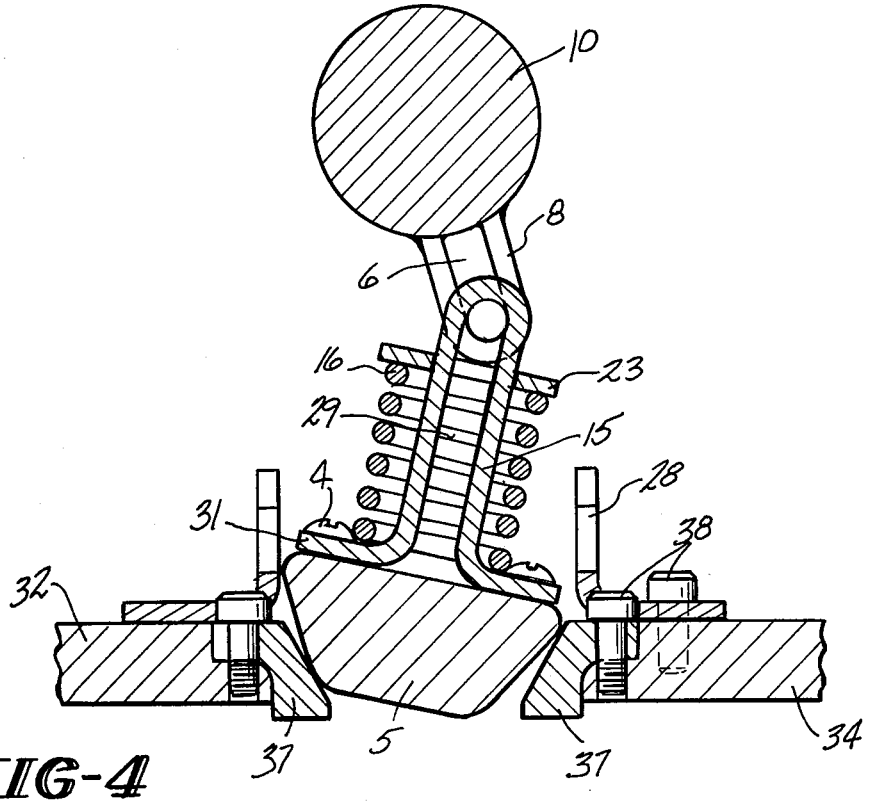
FIG. 4 is a view similar to FIG. 3, but showing the movable tapered bridge contacts in partially disengaged position following counterclockwise rotation of the main shaft.
Figure 5:
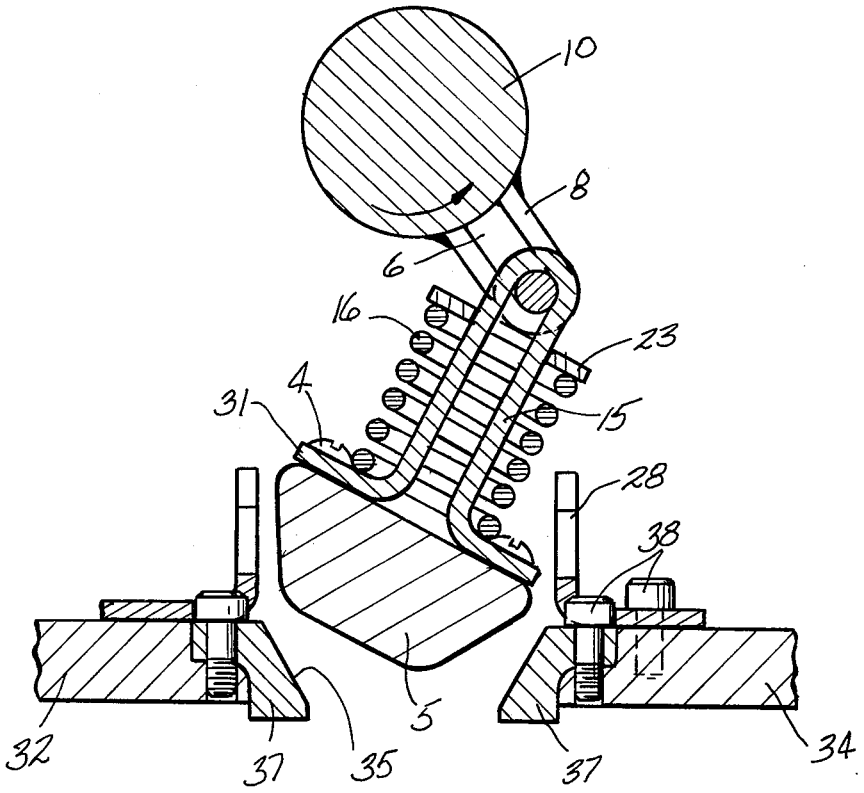
FIG-5 PRIOR ART
FIG. 5 is a view similar to FIG. 3, but showing the movable tapered bridge contacts in fully disengaged position following further counterclockwise rotation of the main shaft.

The operation of the switch is as follows: when the switch is in the operating or closed position movable bridge contacts 5 are in the fully seated position depicted in FIG. 3. Firm contact is maintained via the force of compression springs 16. When it is desired to open the switch, manual or pneumatic force is provided to operating lever 9 to rotate main shaft 10. Main shaft 10 may be rotated either clockwise or counterclockwise. The embodiment of FIGS. 3, 4 and 5 show counterclockwise rotation. During the intermediate stage of rotation depicted in FIG. 4 the force of compression spring 16 causes a wiping action between the contact surfaces of bridge contacts 5 and stationary contact surfaces 35 of bus bar tips 37. Further rotation of shaft 10 causes the lifting of contact and spring support 15 by support shaft 14 which is now being lifted by the bottom of U-shaped arms 8. Thus, tapered bridge contacts 5 are lifted to the open position shown in FIG. 5. It is noted that vertical wall 45 of insulator 28 will act as a guide both during disengagement and engagement of contacts 5. Since the plurality of contact structures are identical in construction single rotation of main shaft 10 will result in simultaneous operation of all members and positive seating and unseating of movable contacts 5. However, in the event slight variations in construction are present, the effect of compression spring 16 would be to positively seat such contacts. The movable contact system can also be designed in such a way as to make one end contact a sacrificial one. That is, it will be the first to make contact and the last to break. This method increases the life of the remaining contacts.

Figure 6:
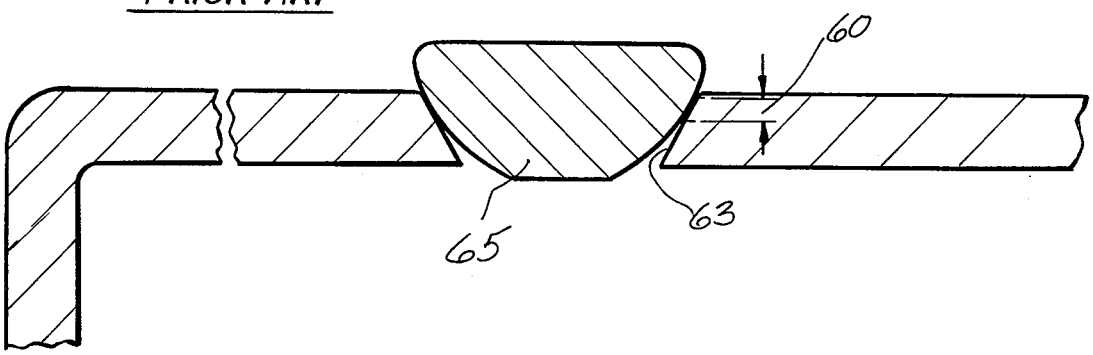
FIG. 6 is a view of a prior art contact engaged with prior art bus bars.

FIG. 6 shows a prior art bridge contact 65 in seated engagement with a prior art beveled bus bar tip 63. As can be seen from this figure, the existing contact area 60 does not extend over the full surface area of the bus bar tip. Limited area contact such as this leads to accelerated burn and corrosion damage of the contacting surface as a result of arcing under the high current loads. The present invention greatly reduces this problem. As seen in FIG. 4, tapered bridge contacts 5 utilize a large surface area to make contact with large mass bus bar tips 37 over contact surface 50. This combination of large mass and large contact area greatly reduces arcing during disengagement of the contacts 5 thereby lessening arc burning damage.

While FIG. 3 depicts large mass bus bar tips 37 which are thicker than bus bars 32 and 34 and which are removably attached thereto, it is within the contemplation of this invention to provide such an increased mass tip as part of a unitary bus bar structure. The preferred embodiment of FIG. 3 however permits easy refurbishing of the switch of FIG. 2 simply by removing allen cap screws 38 and replacing the worn or damaged bus bar tips 37.

Figure 2:
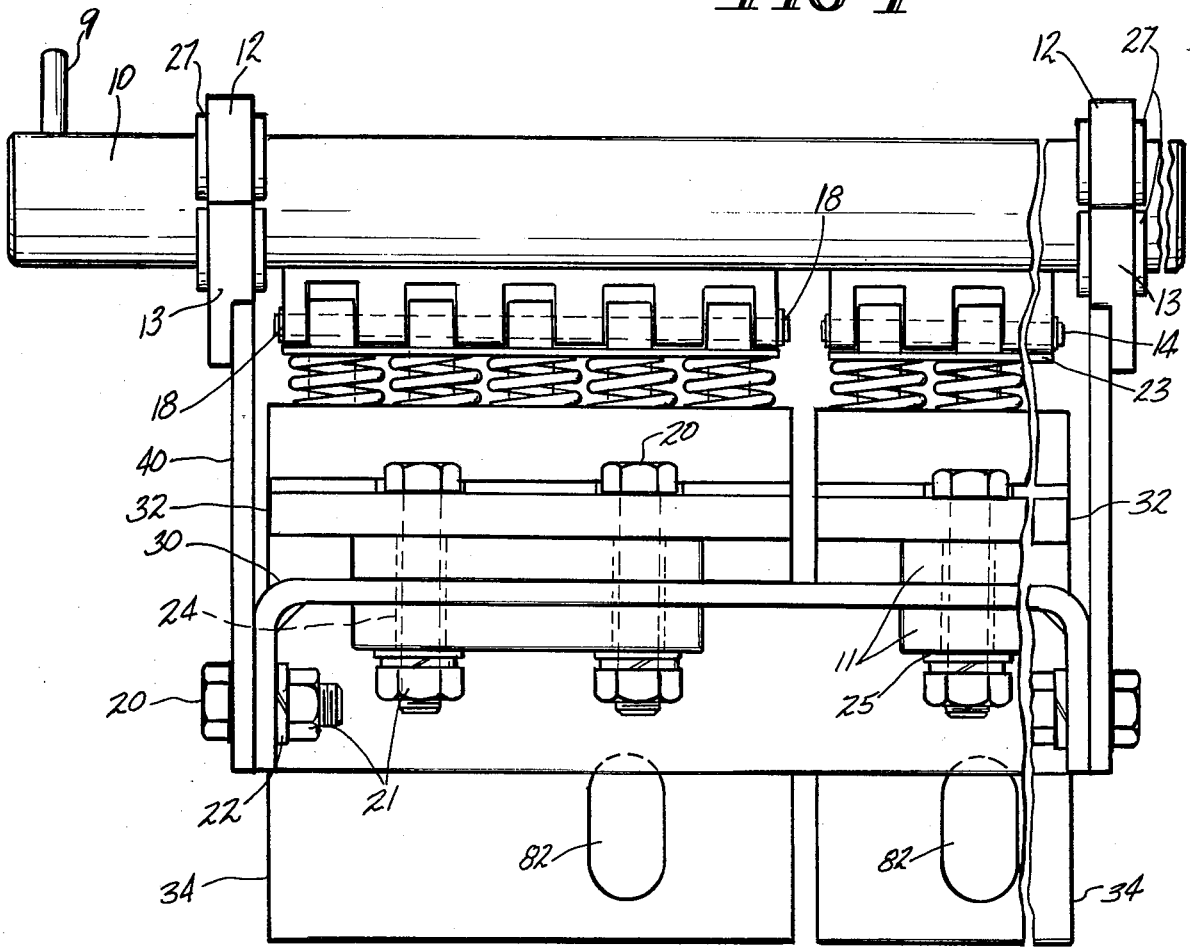
FIG. 2 is a front view of the switch of FIG. 1.

In like manner, when refurbishing of the switch of FIG. 2 is required, screws 4 can be removed permitting ready replacement of worn or damaged movable tapered bridge contacts 5.

Figure 17:
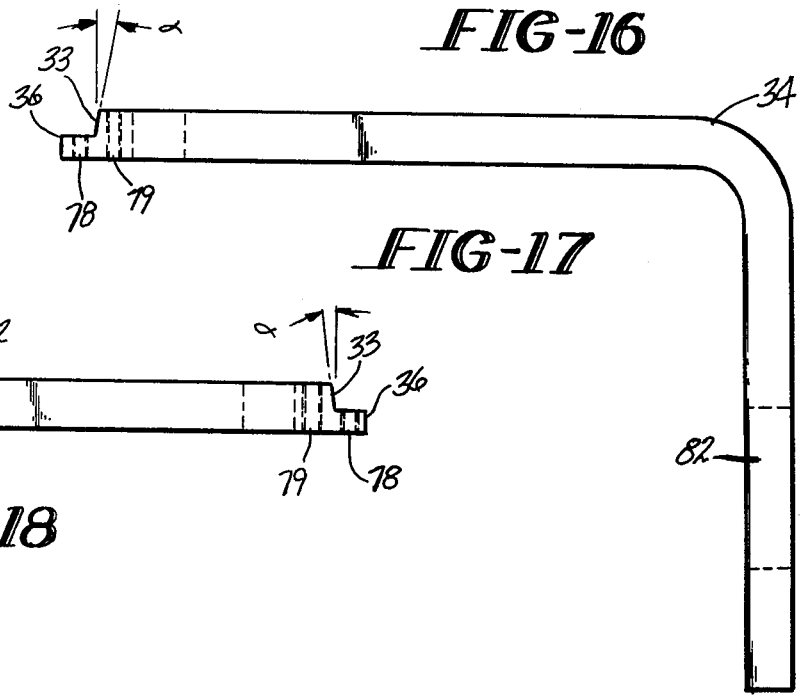
FIGS. 17 and 18 are two embodiments of the bus bars or terminal connectors of the switch of FIG. 2.
Figure 18:
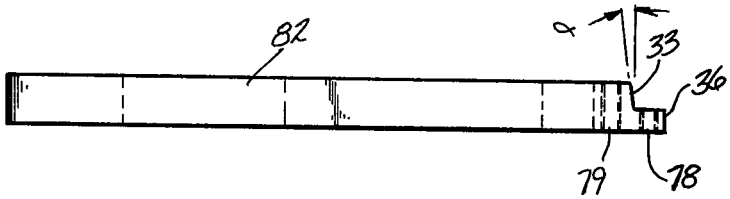
Figure 21:
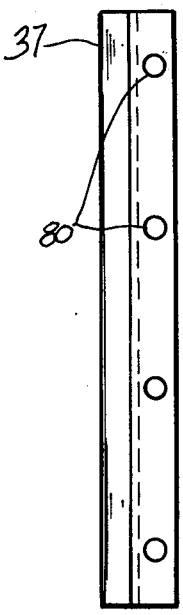
FIGS. 21 and 22 are side and top views respectively of the novel removable bus bar tips of this invention.
Figure 22:
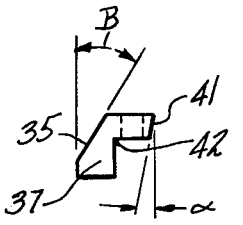

Referring to FIGS. 17 and 18, tip areas of bus bars 32 and 34 are shown with surfaces adapted to receive the removable bus bar tips of FIGS. 21 and 22. Surfaces 33 of bus bars 32 and 34 are provided with a bevel forming an angle $\alpha$ with the vertical while tip 37 is provided with surface 41 having a reverse bevel forming the same angle $\alpha$ with the vertical. When tip 37 is secured to bus bars 32 and 34 by screws 38 as shown in FIG. 3, a jamming action occurs which enhances the resulting contact between bus bars 32 and 34 and tip 37. The value of $\alpha$ may be anywhere from 1° to 89°, but a preferred value of 5° has been determined to be quite effective. Surface 42 of tip 37 should be closely matched to interfit with surface 36 of bus bars 32 and 34 so as to fit firmly upon tightening of screws 38. Bus bars 32 and 34 are also provided with means 78 and 79 for receiving screws 38.

Removable bus bar tips 37 are also provided with a beveled contact surface 35 which forms an angle $\gamma$ with the vertical. The taper of bridge contact 5 also forms an angle $\gamma$ with the vertical. It is preferred that the vertical extent of surface 35 be at least equal to the thickness of bus bars 32 and 34 so that the tapered portion of bridge contact 5 is in contact therewith along an interface 50 at least equal to the thickness of bus bars 32 and 34 when the switch is in closed position (FIG. 3). Values of $\gamma$ preferably range from 15° to 60°, with a most preferred value being 30°.

While removable bus bar tips 37 are shown as being secured by screws 38, it is understood that other securing means such as rivets, dove trailing, welding, soldering, etc. can be employed. However, the use of screws 38 permits refurbishing of the switch without removing it from its installation point.

Figure 9:
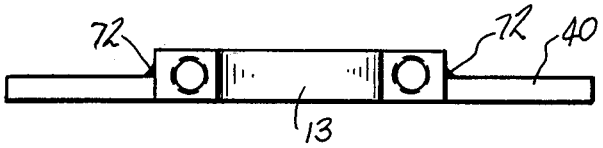
FIG. 9 is a top view of the end plate support assembly of FIG. 7.
Figure 10:
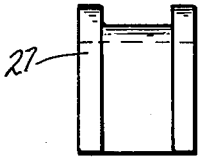
FIG. 10 is a front view of the split bushing of FIG. 7.
Figure 7:
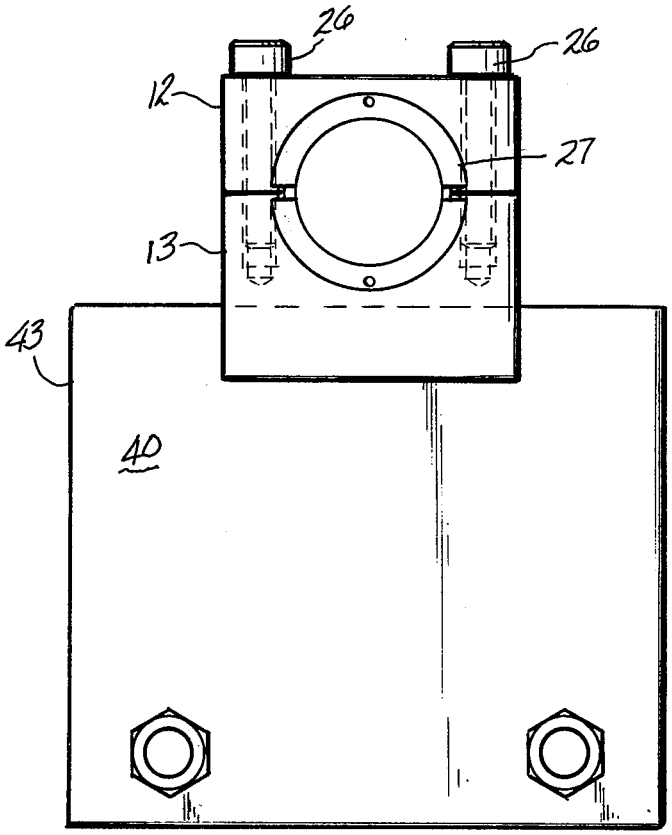
FIG. 7 is a side view of the end plate support assembly of the switch of FIG. 2 showing the main shaft split collars and bushing assembly secured thereto.
Figure 8:
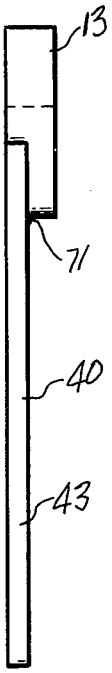
FIG. 8 is a front view of the end plate support assembly of FIG. 7.

The end plate support assembly 40 (FIGS. 7, 8 and 9) comprises a base plate 43 having a lower split collar 13 secured thereto, as by welds 71 and 72. Although it would be possible to provide base plate 43 and collar 13 out of a unitary piece of material, the preferred form is to secure collar 13 as shown in FIGS. 7, 8 and 9. Collar 13 might also be of varying thicknesses and shapes and may be secured to plate 43 on just one side, on one side and the top (FIG. 8), or both sides and the top of plate 43. Split end support or upper split collar 12 is secured to split collar 13 by bolts 26. Split bushings 27, typically of bronze, are inserted in split collars 12 and 13 to form a bearing insert. This arrangement of elements in end plate support assembly 40 enhances the ease with which damaged or worn contact surfaces can be replaced or refurbished. Removal of split collar 12 permits easy removal of main shaft 10 and therefore contacts 5. Contacts 5 can then be readily replaced or refurbished. Access is also then readily available to removable bus bar tips 37, which can be replaced or refurbished.

It should be emphasized that the switch of this invention can be made from either original parts or by altering prior art switches. For example, the switch disclosed in U.S. Pat. No. 2,743,338 to Graybill could be renovated as follows:

First, end plates 15 (FIG. 1 of Graybill) could be replaced or modified to form the end plate support assembly 40 (FIGS. 7, 8 and 9) of this invention.

Second, contacts 11*a* (FIG. 16 of Graybill) could be replaced by tapered contacts 5 (FIGS. 3, 4 and 5) of this invention.

Third, terminal connectors 30 and 31 (FIGS. 1–6 of Graybill) could be machined to provide the contoured tip surface of FIGS. 17 and 18 after which machined or extruded bus bar tips 37 could be secured thereto (FIGS. 3, 4, 5, 21 and 22).

Fourth, an insulator such as insulator 28 (FIGS. 11, 12 and 13) could be substituted for channel units 210–211 (FIGS. 16 and 17 of Graybill) to allow for access to screws 38 which secure tips 37.

Moreover, the movable and stationary contacts of this invention could be utilized in any other switch or device having a bridging contact arrangement.

The patents which are set forth in this application are intended to be incorporated by reference herein.

It is apparent that there has been provided in accordance with this invention an improved high current cell-shorting switch which fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In a short circuiting switch comprising a pair of cooperating contacts for opening and closing an electrical circuit, said cooperating contacts comprising at least one plug-type shaft-thrown, rotatably-engaged movable bridging contact and at least one pair of bus bars having bus terminals forming stationary contacts of a shape to receive said bridging contact, the improvement wherein:

said pair of bus terminals is characterized by beveled edges forming two stationary contact surfaces defining a straight-sided tapered gap between said pair, said taper being in the the direction away from said bridging contact, and said plug-type movable bridging circuit is characterized by two flat tapered contact surfaces conforming to and adapted to fill said tapered gap and contact with said stationary contacts over a large planar area.

2. A short circuiting switch as in claim 1 wherein said bus terminals are of greater thickness than said bus bars.

3. A short circuiting switch as in claim 2 wherein said bus terminals are secured to said bus bars.

4. A short circuiting switch as in claim 3 wherein said bus terminals are removably secured to said bus bars.

5. A short circuiting switch as in claim 4 wherein at least a portion of the interface between the bus terminals and the bus bars is beveled.

6. A short circuiting switch as in claim 4 wherein said bus terminals are secured to said bus bars with threaded fasteners.

7. A short circuiting switch as in claim 1 wherein said bus terminals are secured to said bus bars.

8. A short circuiting switch as in claim 7 wherein said bus terminals are removably secured to said bus bars.

9. A short circuiting switch as in claim 8 wherein at least a portion of the interface between the bus terminals and the bus bars is beveled.

10. A short circuiting switch as in claim 9 wherein the beveled interface forms an angle of at least about 5° with vertical.

11. A short circuiting switch as in claim 8 wherein said bus terminals are secured to said bus bars with threaded fasteners.

12. A short circuiting switch as in claim 1 wherein the tapered surfaces of said bridging contact and the beveled edges of said bus terminals form an angle with vertical of from about 15° to about 60°.

13. A short circuiting switch as in claim 1 wherein the tapered surfaces of said bridging contact and the beveled edges of said bus terminals form an angle with vertical of at least about 30°.

14. A short circuiting switch as in claim 1 wherein the plane area of contact has a vertical extent equal to the thickness of said bus bars.

15. A short circuiting switch as in claim 1 wherein the plane area of contact has a vertical extent greater than the thickness of said bus bars.

16. A short circuiting switch as in claim 1 including a main shaft rotatably mounted on at least two end plate support assemblies secured to a main switch frame for actuating said bridging contact.

17. A short circuiting switch as in claim 16 including at least one elongated slot forming U-shaped arm protruding from said main shaft, at least one movable support member secured at one end to said U-shaped arm by a transverse shaft and having said bridging contact connected at the other end thereof, and a biasing compression spring concentric with said support member.

18. A short circuiting switch as in claim 16 wherein each said end plate support assembly has a set of split collars about said main shaft, the split collars of each set being releasably secured to each other.

19. A short circuiting switch as in claim 1 wherein said bridging contact is removably secured to said support member.

20. A short circuiting switch as in claim 1 wherein said bridging contact is removably secured to said support member with threaded fasteners.

* * * * *

UNITED STATES PATENT AND TRADEMARK OFFICE

CERTIFICATE OF CORRECTION

PATENT NO. : 4,216,364

DATED : August 5, 1980

INVENTOR(S) : Martin H. Dempsey
James F. Rooney

It is certified that error appears in the above-identified patent and that said Letters Patent are hereby corrected as shown below:

Column 2, line 18, delete "disadvatageous" and insert --disadvantageous--.

Column 4, line 4, delete "bolts 30" and insert --bolts 20--.

Column 5, line 35, delete "angle $\gamma$" and insert --angle $\beta$--.

Column 5, line 37, delete "angle $\gamma$" and insert --angle $\beta$--.

Column 5, line 42, delete "Value of $\gamma$" and insert --Value of $\beta$--.

Column 5, line 47, delete "trailing" and insert --tailing--.

UNITED STATES PATENT AND TRADEMARK OFFICE

CERTIFICATE OF CORRECTION

PATENT NO. : 4,216,364

DATED : August 5, 1980

INVENTOR(S) : Martin H. Dempsey
James F. Rooney

It is certified that error appears in the above-identified patent and that said Letters Patent are hereby corrected as shown below:

IN THE CLAIMS

In claim 1, column 6, line 55, delete "circuit" and insert --contact--.

Signed and Sealed this

*Sixteenth* Day of *December 1980*

[SEAL]

*Attest:*

SIDNEY A. DIAMOND

*Attesting Officer*

*Commissioner of Patents and Trademarks*